US006029864A

United States Patent [19]

Nilsson et al.

[11] Patent Number: 6,029,864

[45] Date of Patent: Feb. 29, 2000

[54] CONTAINER

[75] Inventors: Hugo Nilsson, Tutaryd; Karl-Eric Johnsson, Lagan, both of Sweden

[73] Assignee: Nillson, Hugo, Ljungby, Sweden

[21] Appl. No.: 09/180,999

[22] PCT Filed: May 21, 1997

[86] PCT No.: PCT/SE97/00831

§ 371 Date: Nov. 19, 1999

§ 102(e) Date: Nov. 19, 1999

[87] PCT Pub. No.: WO97/44250

PCT Pub. Date: Nov. 27, 1997

[30] Foreign Application Priority Data

May 21, 1996 [SE] Sweden ..... 9601954

[51] Int. Cl.[7] ..... B65D 1/20; B65D 25/40

[52] U.S. Cl. ..... 222/466; 222/461; 222/482; 222/534; 222/536; 220/771

[58] Field of Search ..... 222/465.1, 466, 222/526, 533, 534, 536, 461, 478, 481, 482; 220/288, 303, 768–772

[56] References Cited

U.S. PATENT DOCUMENTS

| | | | |
|---|---|---|---|
| 1,417,951 | 1/1922 | Staples et al. | 222/536 |
| 1,544,503 | 6/1925 | Thomson . | |
| 1,617,992 | 1/1927 | Drake | 222/536 |
| 2,512,105 | 1/1950 | Kooij et al. | 222/481 |
| 4,632,268 | 12/1986 | Melzi et al. | 220/288 |
| 4,733,804 | 3/1988 | Slat et al. | 222/481 |
| 4,781,314 | 11/1988 | Schoonover et al. | 222/482 |
| 5,082,035 | 1/1992 | Maxwell | 222/534 |
| 5,609,272 | 3/1997 | Brass et al. | 222/465.1 |
| 5,671,868 | 9/1997 | Herr | 222/534 |

FOREIGN PATENT DOCUMENTS

| | | |
|---|---|---|
| 195 13 650 A1 | 10/1995 | Germany . |
| 2 225 765 | 6/1990 | United Kingdom . |

*Primary Examiner*—J. Casimer Jacyna
*Attorney, Agent, or Firm*—Davis and Bujold

[57] ABSTRACT

A container (1) for petrochemical products comprises a pour adapter (19), provided with a pour spout (20) and is parallelepiped-shaped, the pour adapter (19) being disposed within an upper corner area (recess 28). In order to control and facilitate respectively a tilting of the container always in a direction towards the pour adapter (19) partly a diagonally disposed handle (9) in the top side (2) of the container is provided and partly on the bottom side (3) of the container a depression (13). Provided one hand seizes the handle and the other hand holds the depression, an automatically controlling outflow moment diagonally through the container towards the pour adapter (19) is simultaneously attained. The pour spout (20) can be swung out from an entirely recessed position into a diagonally outwardly bent position. Also, particular means (11) for filing and/or ventilation are provided, possibly via means mounted in the handle.

7 Claims, 4 Drawing Sheets

26
27
24
25
2
12
11
10
4
6
1
3
5
28
23
19
7

CONTAINER

FIELD OF THE INVENTION

The present invention relates to a container or the like of the type, which is set forth in detail in the preamble of patent claim 1.

BACKGROUND OF THE INVENTION

Such containers are used for e.g. petrochemical products, such as oil and gasoline and are often sold in filling stations to the public. Since the contents often constitutes a biological danger, if it e.g. flows out on the ground or into the water, these containers must meet high environmental requirements. Also, they must meet other requirements, e.g. technical and ergonomical requirements; have a low weight; their manufacture must be easy, simple and quick at reasonable costs. It must be easy to assemble them and this must be done quickly. Also, they must not comprise any bulky parts and it must be easy to transport them, store and use them. It must be possible to make use of the contents completely and to control it at any time. Finally, it must be possible to recycle the containers without problems.

Known containers do not meet these requirements, at least not a substantial or complete combination of the above-mentioned requirements.

DE-A-19 513 650 relates to a container of the type described above. However, this container does not have a shape, which is easy to seize and is ergonomically appropriate. Also, the stacking of such containers is difficult. Advantageous means, which facilitate the outflow of remaining gasoline in the container are missing.

SUMMARY OF THE INVENTION

The object of the present invention is to counteract and remove as much as possible the above-mentioned problems. Also, another object of the invention is to develop the state of the art in this technical field in various respects, even if not specifically mentioned in this description.

These objects are attained by designing a container of the type described in the introduction, mainly according to what is set forth in the characterizing clause of patent claim 1.

BRIEF DESCRIPTION OF THE DRAWINGS

Additional features and advantages of the invention are stated in the following description, reference being made to the enclosed drawings, which show a few embodiments, which however must not be regarded as limiting the scope of protection of the inventive idea. In the drawings:

FIG. 3 as well as FIG. 4 being reduced;

DESCRIPTION OF THE PREFERRED EMBODIMENTS

Figure 1:
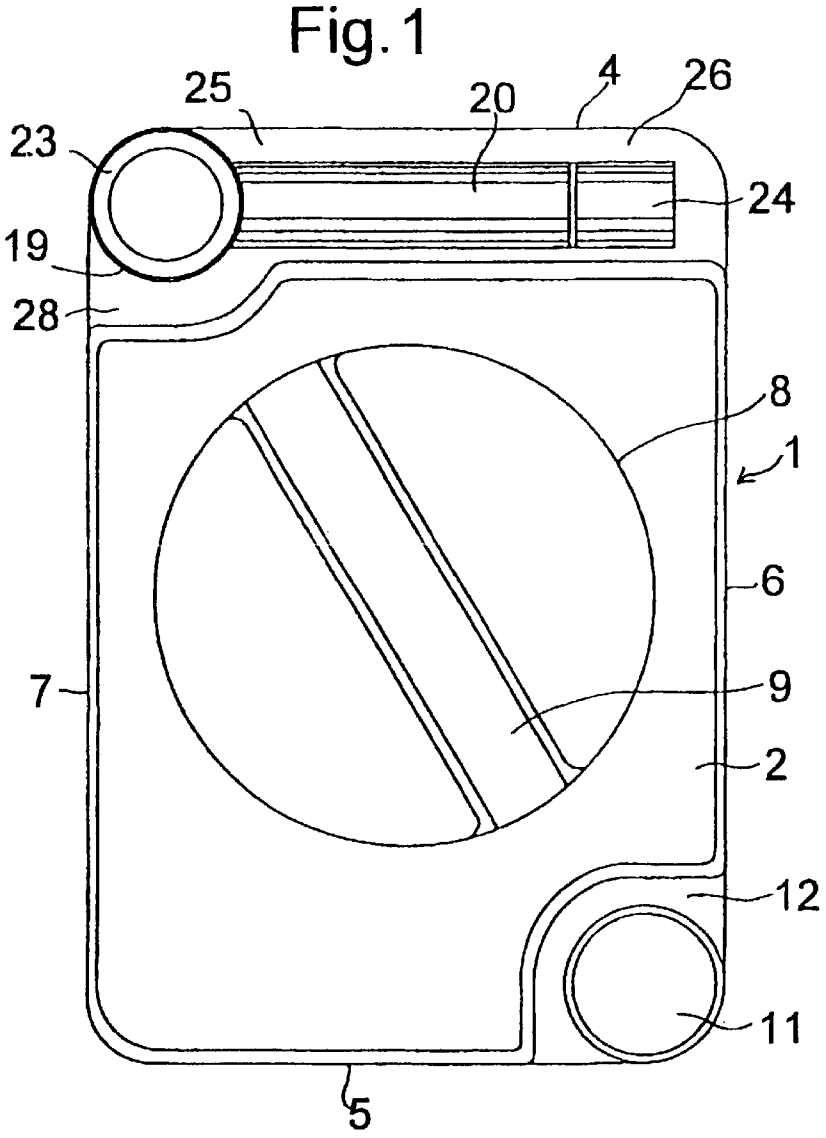
FIG. 1 is a planar view from above of a preferred embodiment of a container according to the invention.
Figure 2:
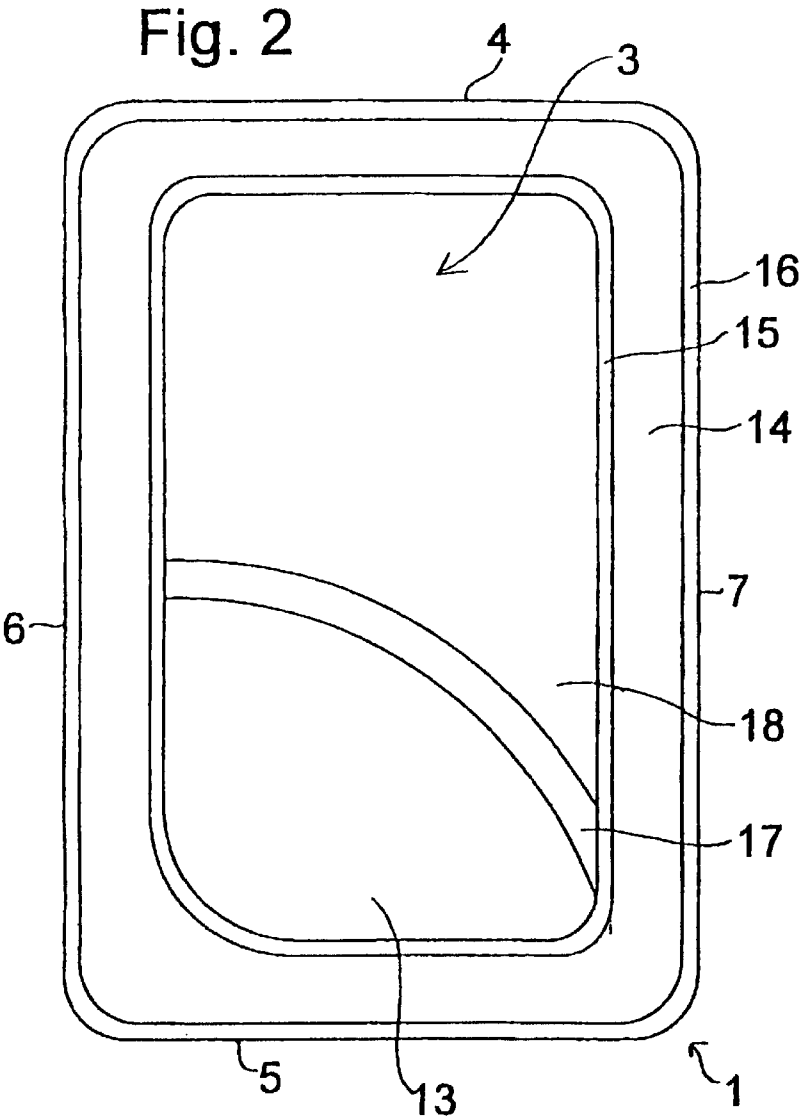
FIG. 2 a planar view of the container according to FIG. 1 from below.
Figures 3, 4:
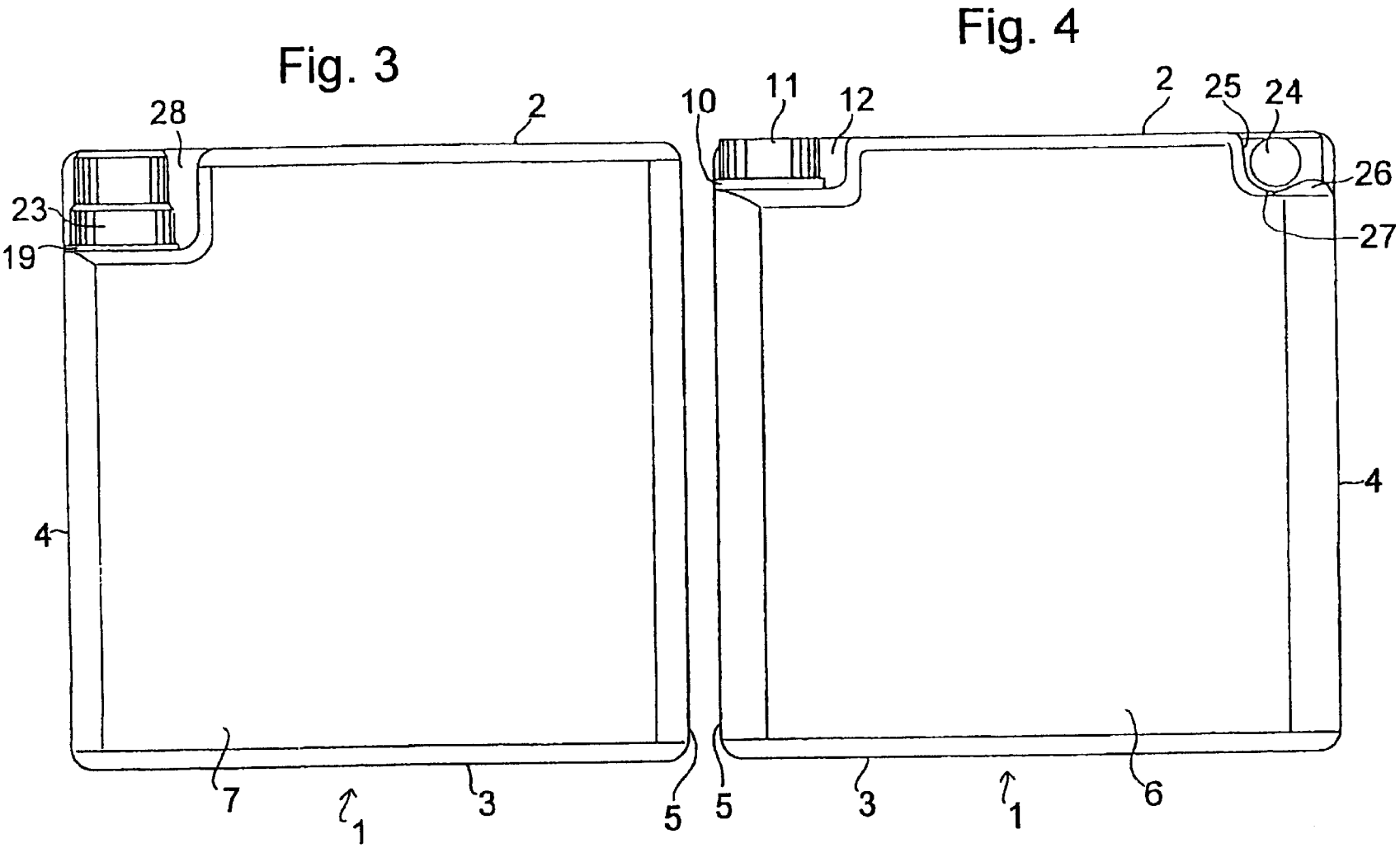
FIG. 3 a view of the container according to FIG. 1 from left in FIG. 1.
FIG. 4 a view from right in FIG. 1.
Figure 6:
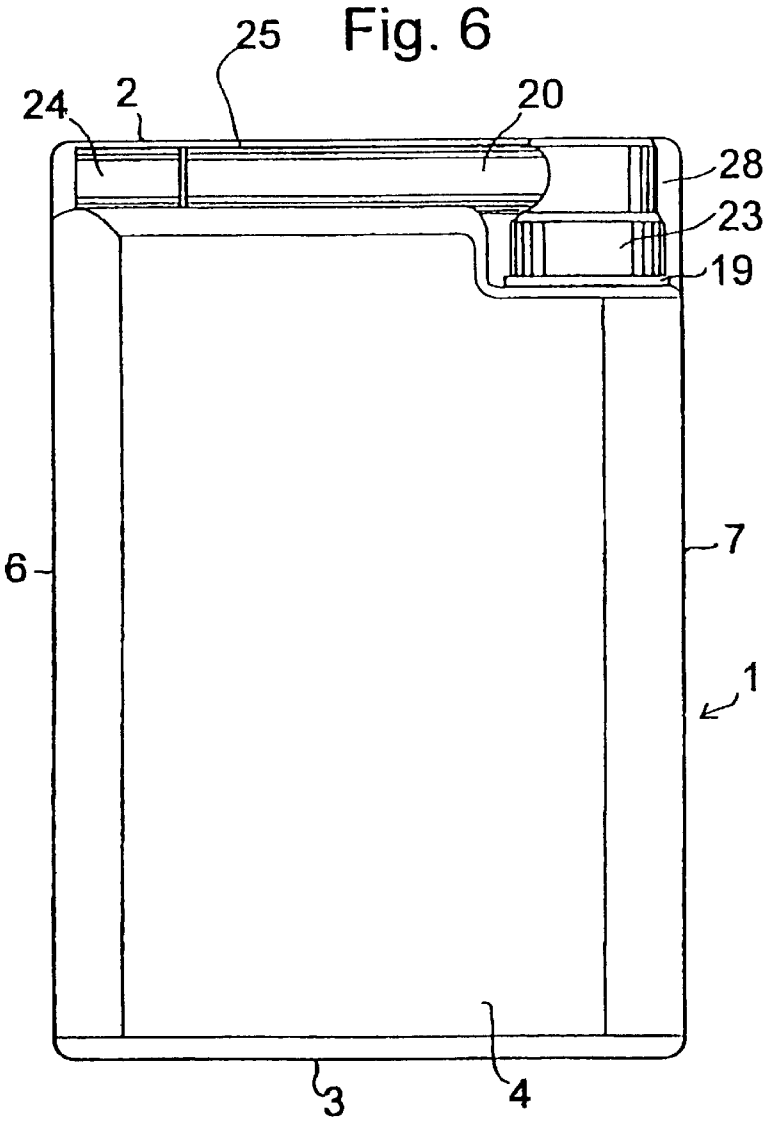
FIG. 6 a view from above in FIG. 1.
Figure 5:
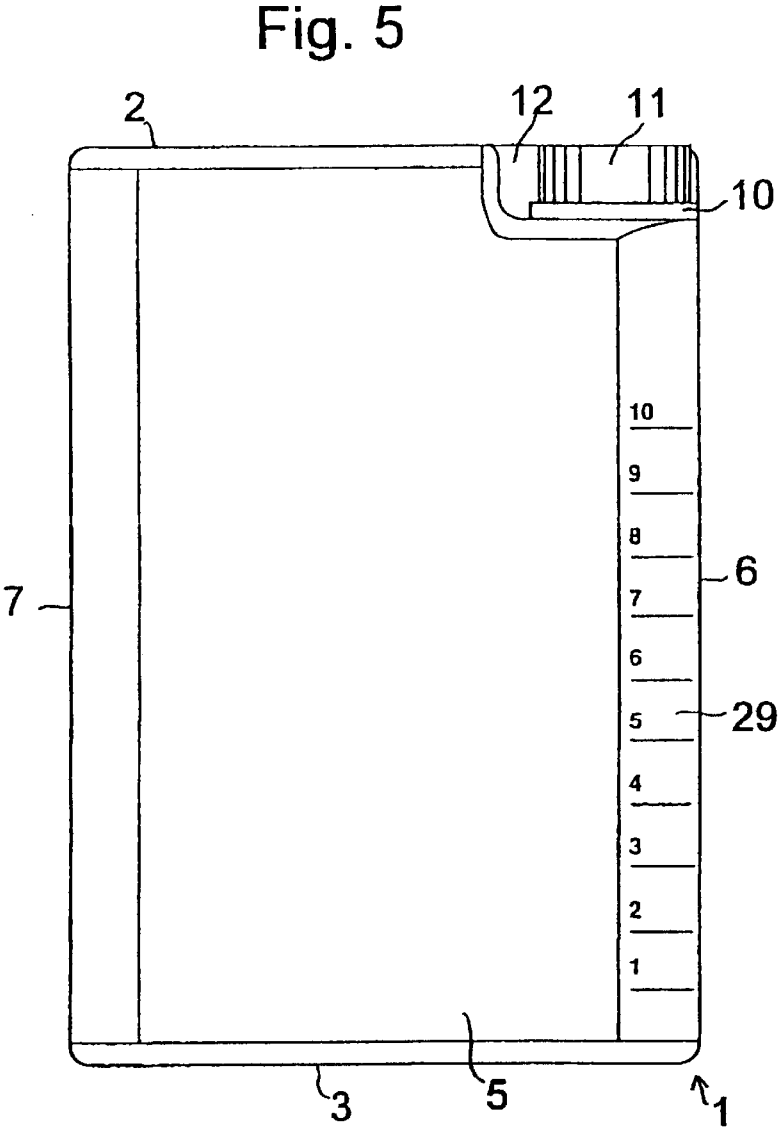
FIG. 5 a view from below in FIG. 1.
Figure 8:
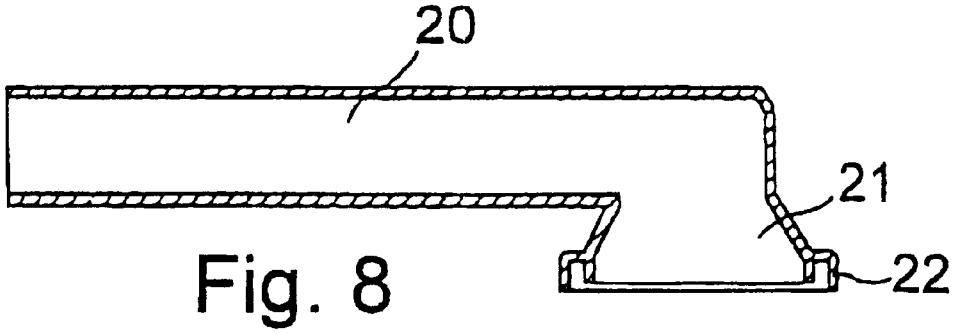
FIG. 8 a view of a diametrically longitudinal section through a pour spout, designed for the container.
Figure 7:
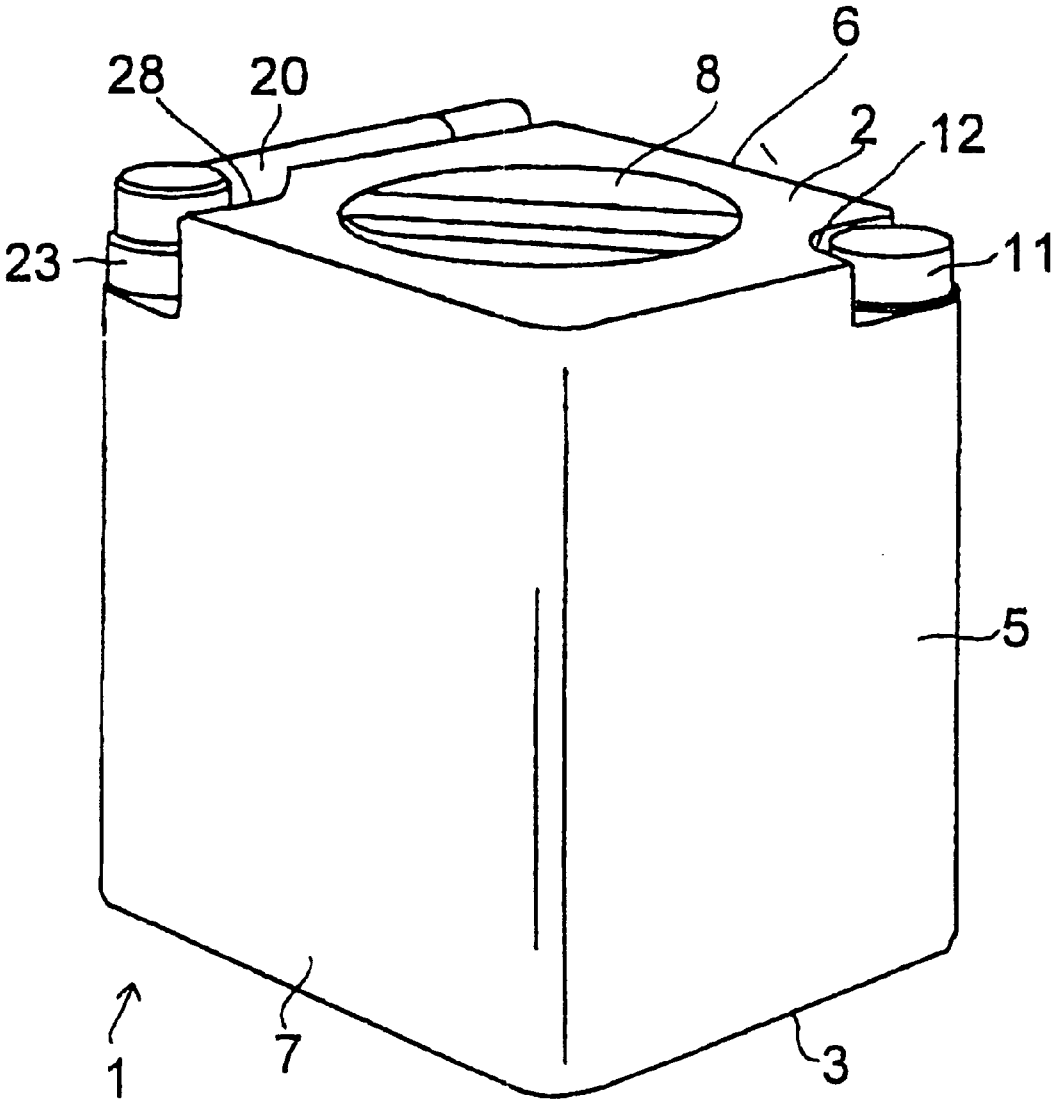
FIG. 7 a prespective view from above of a container according to FIGS. 1–6.

A container 1 according to the present invention and the drawings is shown in its entirety. It has a top side 2, a bottomside 3, narrow sides or gable sides 4 and 5 as well as main sides 6 and 7. It is preferably parallelipiped-shaped with bevelled corners, particularly regarding the vertical corners, whereas the horizontal corners preferably are bevelled to a lesser degree. It is suitably made of a plastic material, e.g. of PE or PP and by means of injection molding or blow moding. The remaining parts of the container, which are described in detail below, suitably are also made of the same material and in the same way, which will facilitate the handling of the containers subsequently to their utilization, i.e. a possible recycling.

In a preferred embodiment of the invention the main sides of the container have the same width and height, whereas the narrow sides have the same dimensions as the top side and the bottom side respectively, the last-mentioned four sides having an oblong rectangular shape and the height of the narrow sides being 10–30% larger than their width. This information is approximate.

Top side 2 is provided with a countersink 8, which preferably is partially spherical and is concentrically disposed and across which a handle 9 extends diagonally, in a direction from one corner of the container, i.e. the corner between sides 5 and 6, to the opposite container corner, i.e. the corner between sides 4 and 7, which handle 9 suitably is made in the form of an integrated piece of the container and is positioned with its top side approximately flush with top side 2. In this way a gripping device is obtained, which does not interfere with the stackability of the containers and which at the same time positively controls the pouring, which will be explained in detail below.

In the corner between sides 5 and 6 there suitably is a filling and/or ventilation adapter 10, which is closed by a screw cap 11. This adapter possibly during the manufacture may be closed by means of a thin membrane (not shown) in order to guarantee in particular, that no gasoline is spilled, atleast until the container is used. The adapter is placed in a recess 12, which is formed from sides 2, 5 and 6, no projecting portions beyond said sides being formed.

Since adapter 10 is disposed within an area with a corner, which is turned away from the pouring side, bottom side 3 of the container, precisely below the adapter area according to one feature of the invention, is provided with a depression 13. This depression suitably is triangular and is located inside a border 14, which extends around the edge area of the bottom side and constitutes the lowest portion of the bottom side and can be limited inwards and outwards by means of bevels 15 and 16 on all sides. The hypotenuse of the depression may constitute a bevel 17 against remaining portion 18 of bottom 3, which is surrounded by bevel 15. Thus, said portion 18 is disposed somewhat higher than border 14.

Handle 9 and depression 13 are two positive control means, one for each hand. Also, the depression is designed to positively control the last remainder of the contents closer to the outflowing zone, a substantially complete emptying being facilitated.

In the corner between sides 4 and 7 a pouring adapter 19 is disposed, on which a pour spout 20 is threaded, which with a funnel-like overflow portion 21 having a downwardly turned annular groove 22 is attached to the pour spout, an overflow nut 23 securing this joining in a way, which prevents gasoline from being spilled, which is a technique known per se in various situations. The free end of the pour spout is closedby means of a lid 24.

The pour spout is pivotable on the pour adapter and can be pivoted into an upper recess 25, which extends along the entire width of the uppermost part of side 4 and requires a portion of top side 2. The bottom of recess 25 preferably is not plane but comprises a rib 26 in that portion, which is exposed to side 4 and results in the formation of a groove 27, which extends along the entire length of the recessed spout and receives it, and consequently is designed to retain the recessed spout, which —in order to occupy this position— from an outwardly swung position must be pressed beyond rib 26, structural and/or inherent elasticity being utilized.

Also, temporary position securing means for the spout in its outwardly swung position may possibly be used, which are not shown, because they are known per se. They will then indicate by means of a sensor and/or optical means a spout position, which is flush with handle 9. They may be disposed in recess 28 for the spout adapter, which recess is made in sides 2, 4 and 7 and may be a little deeper than recess 25, vertically as well as horizontally.

When the spout is inserted according to the drawings, containers according to the invention can be stacked, transported etc. In case the container is to be used, i.e. in case a portion of the contents is to be poured out of the container, the spout is to be swung out to a position flush with the handle, which is to be seized by one hand, while the other is to hold depression 13 below the container, which then jointly with the handle in a positive way controls the pour direction, which is diagonal in relation to the container. It is easy, using the depression, to lift the container and control its direction by means of the handle, the pouring being done with the liquid in the container flowing towards sides 4 and 7, which in a way form a groove, resulting inless gurgling and less lateral liquid distribution and less uneven outflow. The liquid flows instead without air admixture and with an even flow, which in a satisfactory way corresponds to the size of the pour spout outlet. In this situation it may be advantageus to provide the handle with a longitudinal hollow space, which ends in the pour adapter and communicates with the area inside the ventilation adapter. However, the latter can be designed to allow air inflow by perforating or removing a possibly used membrane or by loosening screw cap 11 somewhat.

Also, the spout and/or the pour adapter can be provided with opening and closing means respectively, known per se, which result in that the outflow is blocked automatically, when the spout is recessed, and is opened up, when the spout is bent outwards. In the corner area between sides 5 and 6 a scale 29 suitably is provided, which will indicate the level of the liquid in the container, the container as such being translucent or the scale area being made of such a material.

Depression 13 can also or even alternatively be located in the adjacent corner area, which belongs to the same narrow side 5. The latter location may be preferable, in case handle 9 is seized from below, by e.g. the right hand. Then it seems awkward to let the left hand so to speak pass the right hand. However, if on the other hand, which seems to be normal, the handle is seized by e.g. the left hand from above, i.e. the palm of the hand rests on top of the handle, then the left arm is in a natural way directed roughly perpendicularly to the longitudinal direction of the handle. Then it seems also natural and ergonomically correct to, with the fingers of the right hand, seize the depression, which likewise is located on the right side of the container, and carry out the pouring in an ergonomically controlled way.

According to a modified embodiment (not shown) pour spout 20 can end e.g. a few centimeters, before it has reached side 6. Then top side 2 can extend inside this corner area with a narrow section all the way to side 4. In this way a larger disposition surface for a container stacked on top of the container is obtained and consequently a better stability, a somewhat larger volume and an improved protected recess position for the pour spout.

We claim:

1. A container (1), which comprises a handle (9) and a pour adapter (19), the container being at least approximately parallelepiped-shaped and the pour adapter (19) being disposed within an upper corner area recess of the container (28), a positive ergonomical control means (9 and 13) being provided in order to direct the flow diagonally through the container towards the pour adapter, which means partly comprise a recess (8), located in the top side (2) of the container, through which said handle (9) extends diagonally, from one corner of the container to another corner, and which means partly comprise holding means (13), located on the bottom side (3) of the container;

wherein on the pour adapter (19) a pour spout (20) is swingingly mounted, which in its rest position is recessed in an upper recess (25), which uses a portion of one container side (4) and the top side (2), and which pour spout (20) can be swung outwards into a pouring position, flush with the handle (9), and in that said holding means comprises a depression (13), disposed in a corner area in the bottom side (3) of the container, which corner area is turned away diagonally from the corner side for the pour adapter (19).

2. The container according to claim 1, wherein said recess for the handle (9) surrounds the handle (9) and is a partially spherical recess (8), which is centrically disposed in the top side (2) of the container.

3. The container according to claim 1, wherein in the top side (2) of the container, in the corner, which is diagonally turned away from the pour adapter, one of a filling and ventilation adapter (10) is disposed, which is closed by a screw cap (11) and which during the manufacture is closed by a thin membrane, in order to guarantee that no petrol is spilled, at least until the use of the container, and which adapter (10) is recessed into a recess (12), which is formed in the three adjacent sides (2, 5, 6) in order to prevent the formation of portions, which project beyond these sides.

4. The container according to claim 1, wherein said depression (13) is triangular and is disposed inside a border (14), which extends along the edge area of the bottom side (3) of the container on all sides and constitutes the lowermost portion of the bottom side, which border preferably is limited inwards and outwards by bevels (15, 16) on all sides, the hypotenuse of the depression (13) preferably being a bevel (17) against the remaining portion (18) of the area of the bottom side (3), which is surrounded by the inner bevel (15), which portion (18) consequently is disposed at a somewhat higher level than the border (14).

5. The container according to claim 1, wherein the handle (9) and the depression (13) are to be used as positive control means for each hand, the depression also being designed to positively control the last remainder of the contents of the container close to the outflow zone in order to facilitate an almost complete emptying.

6. The container according to claim 1, wherein on the pour spout (29) a funnel-like overflow part (21) is threaded, having a downwardly turned annular groove (22) on the pour adapter (19), an overflow nut (23) being mounted in order to guarantee, that this joining will not allow spilled petrol and the free end of the pour spout being closed by a lid (24).

7. The container according to claim 1, wherein the recess (25) for the pour spout (20) extends along the entire width of the uppermost portion of the respective container side (4) and in that the bottom of this recess (25) is a rib (26) in its part, which faces said container side (4) in order to form a groove (27), which extends along the entire length of the recessed spout and receives it, said groove (27) being designed to retain the recessed spout, and said spout, in order to occupy this position, being designed to be pressed beyond said rib (26), structural and/or material elasticity being utilized.

* * * * *